US010655372B2

(12) United States Patent
Meredith

(10) Patent No.: US 10,655,372 B2
(45) Date of Patent: May 19, 2020

(54) WINDOW SASH RESTRAINT DEVICE

(71) Applicant: Dale Herbert Meredith, New South Wales (AU)

(72) Inventor: Dale Herbert Meredith, New South Wales (AU)

( * ) Notice: Subject to any disclaimer, the term of this patent is extended or adjusted under 35 U.S.C. 154(b) by 388 days.

(21) Appl. No.: 15/166,900

(22) Filed: May 27, 2016

(65) Prior Publication Data

US 2016/0273249 A1 Sep. 22, 2016

Related U.S. Application Data

(63) Continuation of application No. PCT/AU2014/001084, filed on Nov. 27, 2014.

(30) Foreign Application Priority Data

Nov. 27, 2013 (AU) ..... 2013904577

(51) Int. Cl.

| | |
|---|---|
| ***E05C 17/22*** | (2006.01) |
| ***E05B 15/10*** | (2006.01) |
| ***E05C 17/32*** | (2006.01) |
| ***E05B 65/00*** | (2006.01) |
| ***E05B 65/08*** | (2006.01) |

(Continued)

(52) U.S. Cl.

CPC ..... *E05C 17/22* (2013.01); *E05B 15/101* (2013.01); *E05B 17/2026* (2013.01); *E05B 65/0014* (2013.01); *E05B 65/0864* (2013.01); *E05C 1/06* (2013.01); *E05C 17/32* (2013.01); *E05C 17/48* (2013.01); *E05C 17/60* (2013.01); *E05C 17/04* (2013.01); *E05C 2007/007* (2013.01)

(58) Field of Classification Search

CPC ..... E05C 17/22; E05C 17/48; E05C 17/60; E05C 17/62; E05B 65/0864; E05B 15/101

USPC ..... 49/449, 450; 292/DIG. 20

See application file for complete search history.

(56) References Cited

U.S. PATENT DOCUMENTS 390,507 A * 10/1888 Morton
546,649 A * 9/1895 Bray
(Continued)

FOREIGN PATENT DOCUMENTS

GB 2259939 A 3/1993

OTHER PUBLICATIONS

International Search Report, dated Jan. 29, 2015, with Written Opinion for corresponding International Application No. PCT/AU2014/001084.

*Primary Examiner* — Gregory J Strimbu
(74) *Attorney, Agent, or Firm* — Myers Wolin, LLC

(57) ABSTRACT

A window sash restraint device for selectively restraining a window sash in one of an open position and a closed position relative to a window frame. The window sash restraint device includes a body adapted to be fixed directly to the frame or sash and a restraining member which in an active condition, restrains the sash in either the open position or the closed position relative to the frame and when inactive allows movement of the sash relative to the opened or closed positions. The device further comprises a manually releasable restraining mechanism for holding the restraining member in the active condition. The device is adapted to restrain the sash in the opened position, with an opening small enough to prevent a child from falling out of the window yet secure enough to prevent the child from further opening and falling from the window.

12 Claims, 7 Drawing Sheets

(51) Int. Cl.

| | |
|---|---|
| ***E05C 17/48*** | (2006.01) |
| ***E05C 17/60*** | (2006.01) |
| ***E05B 17/20*** | (2006.01) |
| ***E05C 1/06*** | (2006.01) |
| *E05C 7/00* | (2006.01) |
| *E05C 17/04* | (2006.01) |

(56) References Cited

U.S. PATENT DOCUMENTS

| | | | | | |
|---|---|---|---|---|---|
| 559,982 | A | * | 5/1896 | Madion | |
| 895,808 | A | * | 8/1908 | Steele | |
| 956,427 | A | | 4/1910 | Roy | |
| 1,544,387 | A | * | 6/1925 | McCrea | E05C 17/22 160/103 |
| 2,357,608 | A | | 9/1944 | Ostrowski | |
| 2,426,399 | A | | 8/1947 | Lipani | |
| 3,526,421 | A | | 9/1970 | Hirschler | |
| 3,768,847 | A | * | 10/1973 | Buck, Jr. | E05B 65/0864 292/179 |
| 4,699,406 | A | * | 10/1987 | Swanson, Jr. | E05B 65/0864 292/175 |
| 4,759,575 | A | * | 7/1988 | McKnight | E05B 53/001 292/144 |
| 8,182,001 | B2 | * | 5/2012 | Tremble | E05B 15/102 292/138 |

* cited by examiner

WINDOW SASH RESTRAINT DEVICE

CROSS-REFERENCE TO RELATED APPLICATIONS

This application is a continuation of PCT/AU2014/001084, filed on Nov. 27, 2014, which claims priority to Australian Patent Application 2013904577, filed Nov. 27, 2013, the entirety of each of which are hereby incorporated by reference.

FIELD OF THE INVENTION

This invention relates to a device for selectively restraining a window sash in an open position and/or a closed position. The invention is particularly, but not exclusively, suitable for selectively restraining window sashes of sliding sash, single hung sash, double hung sash, awning sash and casement windows.

BACKGROUND

Windows that are used in the construction of buildings often are of the type comprising a movable panel of glass known as a "sash". Common window types include single or double hung sash windows, sliding sash, awning sash and casement sash windows wherein the frame of the window and the frame of the sash containing the window glass is made of aluminium, timber, steel or PVC. Such windows are often used in the construction of residential dwellings in single or multi-level residential buildings, apartment buildings, commercial and industrial structures and the like. Single-hung sash and double-hung sash windows include at least one window sash that is movable in a vertical direction and sliding sash windows have at least one sash that is movable in a horizontal direction. Awning sash and casement windows include at least one window sash that pivots relative to a window frame. A problem with such windows is that children can and do fall out of them. Where such windows are employed in the construction of dwellings that are elevated above ground level, such as in multi story residential dwellings, apartment buildings and the like, a child falling out of such a window can suffer serious injury or death.

A solution to the problem of children falling out of windows is to restrict the extent to which the window can be opened. By restricting the extent to which a window can be opened children can be prevented from falling out of a window whilst still enabling windows to be opened to provide for ventilation. Existing window restrictors involve simply preventing a window sash from being opened beyond a certain amount but do not maintain the window open or closed. Furthermore, such restrictors may not be resistant to operation by a child and, therefore, may not prevent a child from deactivating the restrictor.

Other means of restricting the extent to which a window can be opened include window locks having a key operated lock that is operable to lock a bolt which passes through the frame of the window sash and either the frame of the window or of another window sash to thereby lock the sash window in a predetermined open position. A problem with such window locks is that as they include a key operated lock thus rendering the window lock relatively expensive to manufacture. Furthermore, such window locks require the use of a key to operate the lock which is problematic because such keys can and do go missing and it is not recommended to leave the key in the lock as the lock can then be operated by a child which is not desirable. If the key for a window lock is misplaced then the lock may be rendered useless and need to be removed from the window in order to enable the window to be opened and closed. Furthermore, in the event of a fire, it may not be possible for a person within the dwelling to reach the key to unlock the window lock and exit the dwelling. It may also not be possible for a person outside the dwelling, such as fire or emergency response personnel, to unlock the window lock and enter the dwelling without breaking the window and risking injury associated with entering or exiting a window containing broken glass.

Accordingly, a need exists for a means of restraining a window sash in an open position that is small enough to prevent a child from falling out of the window yet which is secure enough to prevent the child from further opening and falling out of the window. There also exists a need to provide a means of restraining a sash window in an open position or a closed position that is relatively inexpensive and alleviates problems associated with key operated window locks.

SUMMARY

Accordingly the present invention provides a window sash restraint device for selectively restraining a window sash in an opened or closed position relative to a window frame, the device including:

- a body adapted to be fixed relative to the window sash;
- a restraining member coupled to the body and having an active condition and an inactive condition, in the active condition the restraining member restrains the window sash in an opened position or a closed relative to the window frame and in the inactive condition the restraining member allows movement of the window sash relative to the opened or closed positions; and
- a restraining mechanism for holding the restraining member in the active condition, wherein the restraining mechanism is manually releasable to thereby release the restraining member from the active condition.

It is to be appreciated that the reference herein to fixing the body relative to the window sash may include fixing the body directly to the window sash or fixing the body directly to the window frame depending on the window type and configuration with which the device is to be used.

Preferably, the restraining mechanism is manually releasable by a manual release means configured for concurrent two handed manual operation.

The manual release means preferably includes one or more manually displaceable first release members that are manually displaceable from a rest position to a displaced position and a manually displaceable second release member that is manually displaceable from a rest position to a displaced position.

Preferably, the second release member is operable to release the restraining mechanism only when the one or more first release members is in its displaced position and wherein the restraining mechanism is released when the second release member is in its displaced position.

The manual release means preferably includes a pair of the manually displaceable first release members that are each independently displaceable from respective rest positions to respective displaced positions, wherein the second release member is operable to release the restraining mechanism only when the pair of first release members are both in their respective displaced positions.

Preferably, the one or more first release members are biased from their displaced position towards their rest position and the second release member is biased from its displaced position towards its rest position.

In an embodiment, the one or more first release members includes a pair of manually operable members at substantially opposite ends of the body.

Preferably, the one or more first release members are in the rest position when both of the manually operable members extend from the opposite ends of the body and are in the displaced position when both of the manually operable members are manually displaced towards the body.

Manual displacement of the second release member preferably includes manually displacing the second release member relative to the body.

Preferably, the second release member includes a lever that is manually displaceable away from the body.

Preferably, the first release member is displaceable in a direction that is transverse to a direction in which the second release member is displaceable.

The restraining mechanism can include a securing member that engages the restraining member when in the active condition and that disengages the restraining member when the restraining mechanism is released.

Preferably, the restraining mechanism is adapted for automatically securing the restraining member in response to manual actuation of the restraining member from the inactive condition to the active condition.

Preferably, the restraining member includes a bolt that is movable between extended and retracted positions relative to the body, wherein the active condition of the restraining member corresponds with the bolt being in the extended position and the inactive condition of the restraining member corresponds with the bolt being in the retracted position.

Preferably, the bolt is biased towards its retracted position upon release of the restraining mechanism.

Preferably, the restraining member is adapted in the extended position to enter an opening in a first window sash to which the device is directly fixed and one or more openings in a second window sash or a window frame to which the device is not directly fixed to restrain the first window sash relative to the window frame in an open position or a closed position.

Preferably, the restraining member is adapted in the extended position to enter an opening in a window frame to which the device is directly fixed and one or more openings in a window sash to which the device is not directly fixed to restrain the window sash relative to the window frame in an open position or a closed position.

Preferably, the device further includes an elongated stay member having a first end that is pivotally mounted to the window frame or the window sash and a second end that is engageable by the restraining member in the active condition when the body is fixed to the other one of the window frame and the window sash.

In another aspect, the present invention provides a window including the window sash restraint device of any one of the preceding claims.

In another aspect, the present invention provides a method for selectively restraining a window sash in an opened or closed position relative to a window frame, the method including:

fixing a window sash restraint device relative to a window sash, the device including:

a body adapted to be fixed relative to the window sash;

a restraining member coupled to the body having an active condition and an inactive condition; and a restraining mechanism that is operable for securing the restraining member in the active condition, wherein the restraining mechanism is manually releasable to release the restraining member from the active condition; moving the window sash to an opened or closed position relative to the window frame;

actuating the restraining member from the inactive condition to the active condition, whereby the restraining member restrains the window sash in the opened or closed position.

The method can further include automatically securing the restraining member in response to manual actuation of the restraining member from the inactive condition to the active condition.

Preferably, the method includes releasing the restraining mechanism by concurrent two handed operation of a manually operable release means.

Operating the release means preferably includes manually displacing one or more first release members that are manually displaceable from a rest position to a displaced position and concurrently manually displacing a second release member that is manually displaceable from a rest position to a displaced position, wherein upon displacement of the second release member the restraining mechanism is released and the restraining member is released from the active condition.

Preferably, operation of the release means includes manually displacing a pair of the manually displaceable first release members that are each independently displaceable from respective rest positions to respective displaced positions, wherein the second release member is operable to release the restraining mechanism only when the pair of first release members are both in their respective displaced positions.

BRIEF DESCRIPTION OF THE DRAWINGS

The present invention will now be described with reference to preferred embodiments of the invention such as those that are illustrated in the drawings, wherein.

DETAILED DESCRIPTION OF THE PREFERRED EMBODIMENTS

Figure 1:
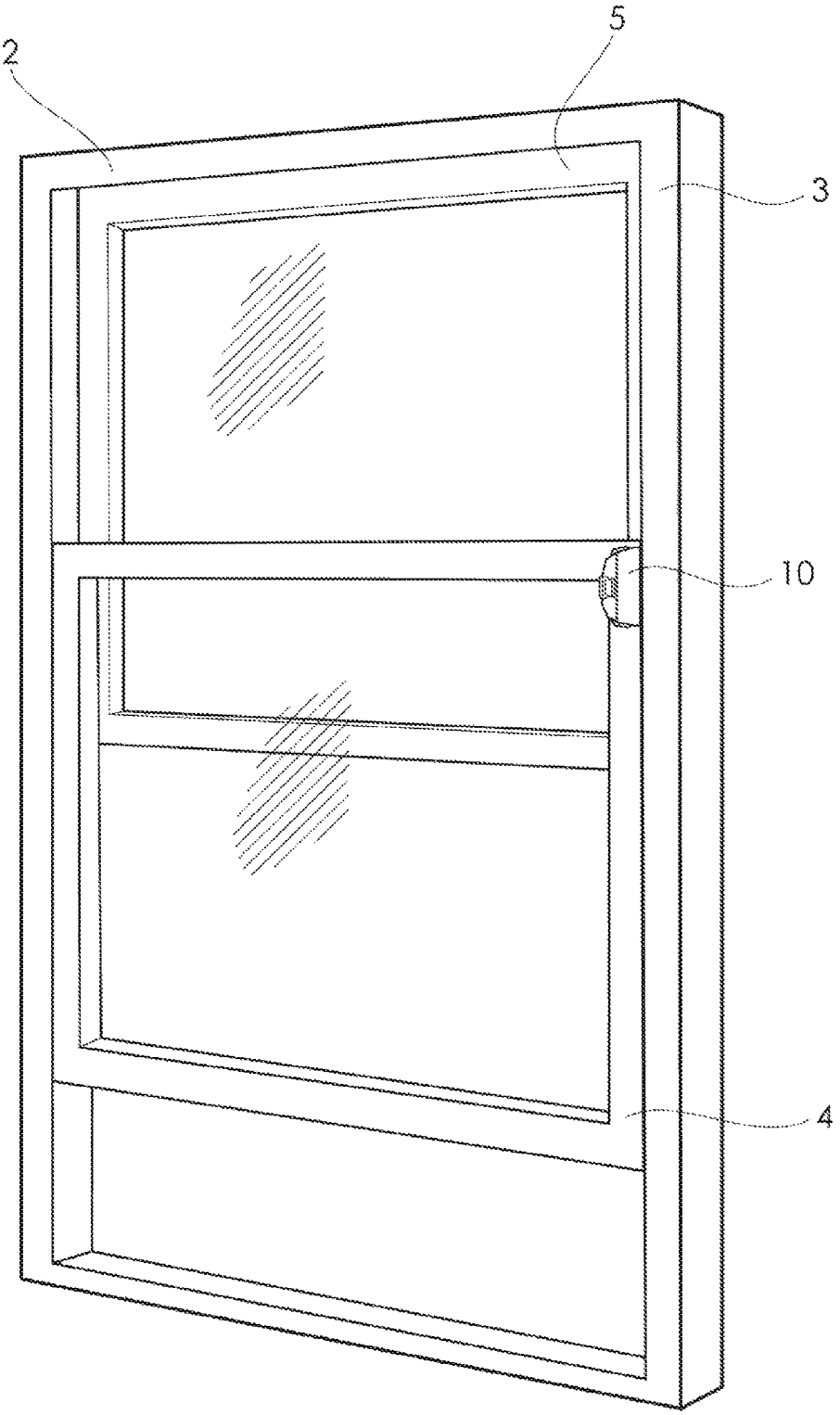
FIG. 1 illustrates a perspective view of a single or double hung sash window including a window sash restraint device in accordance with an embodiment of the invention wherein the device is operable to selectively restrain a window sash in an open position.
Figure 11:
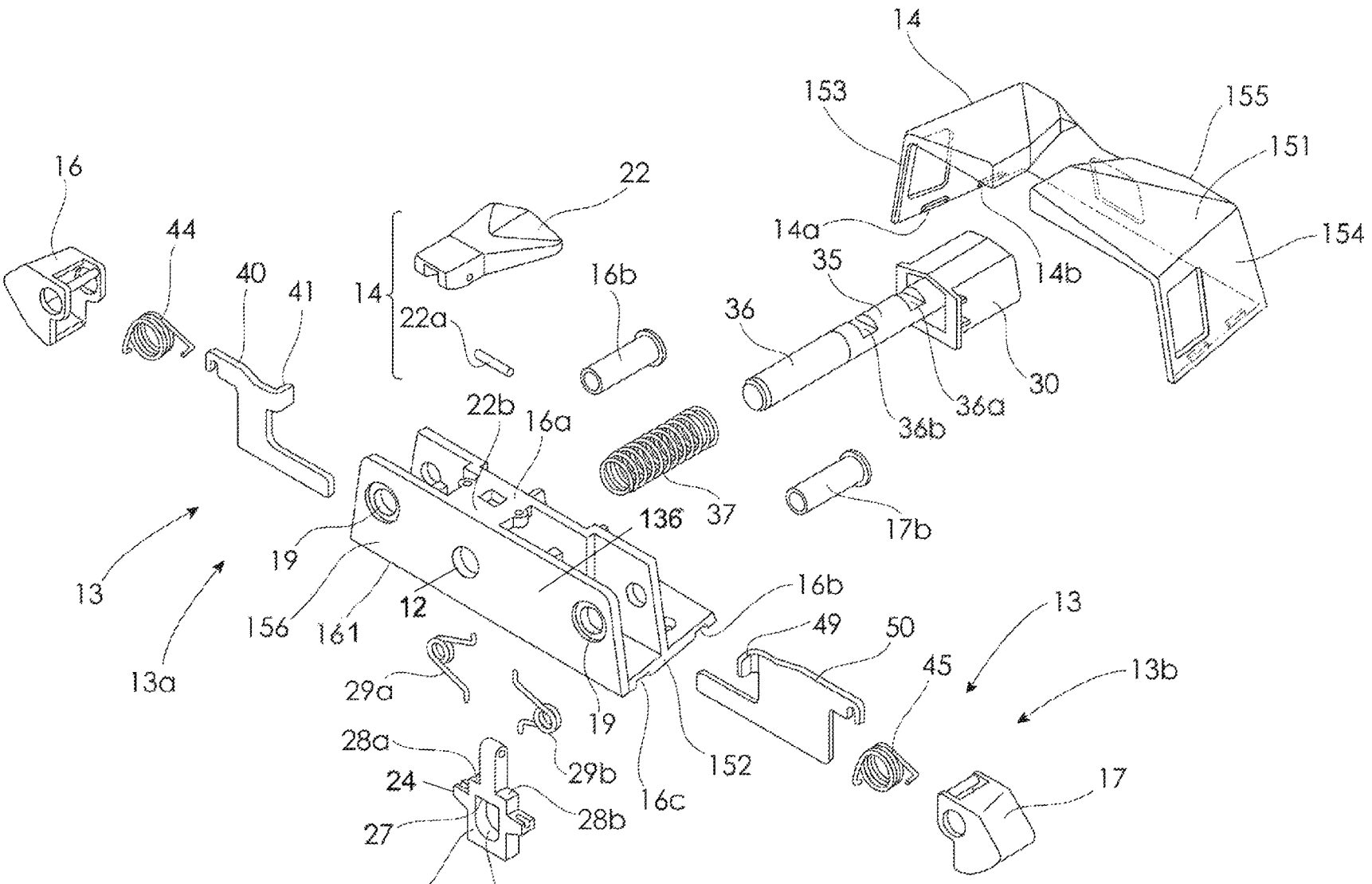
FIG. 11 is an exploded perspective view of the device of the preceding figures.
Figure 14:
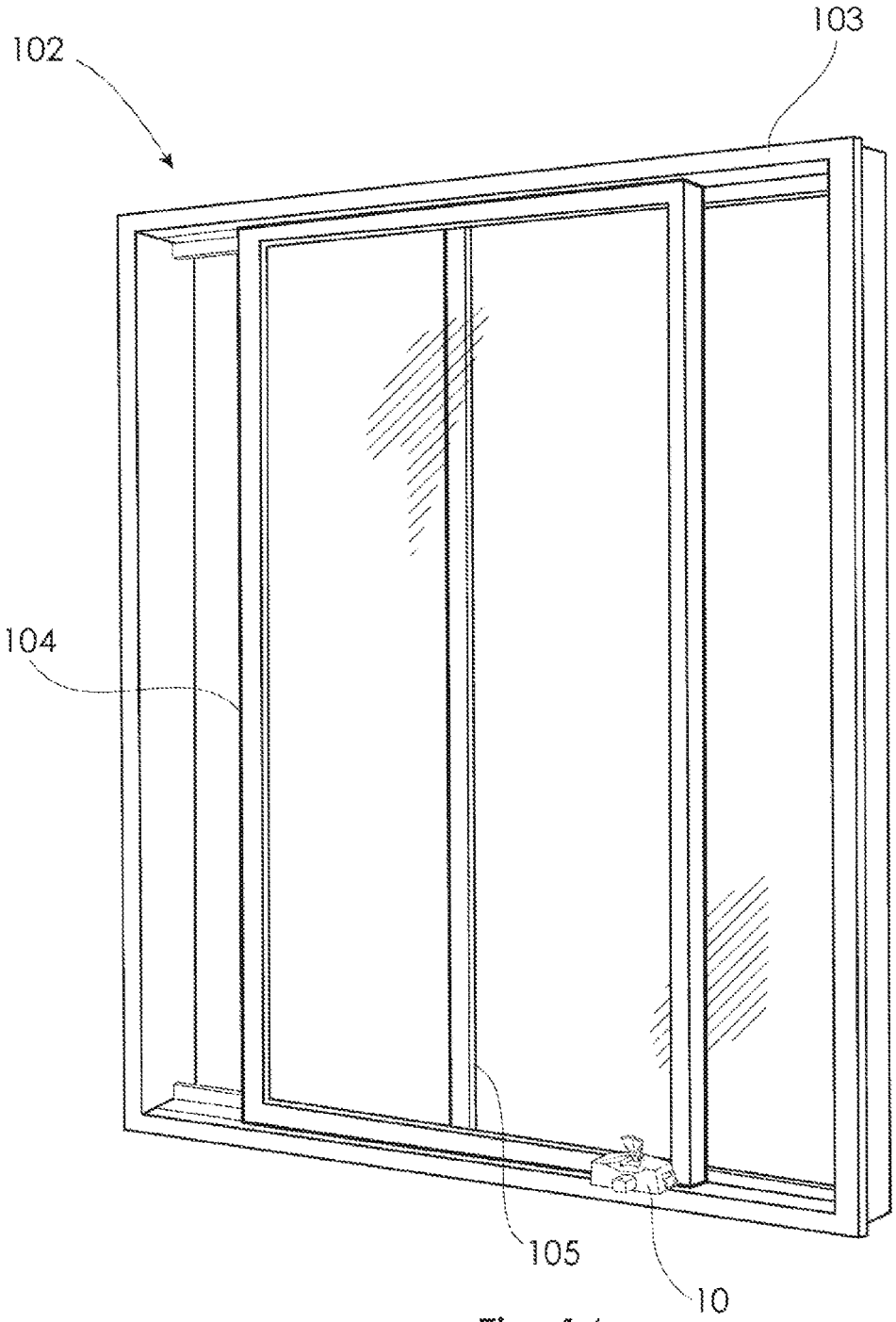
FIG. 14 illustrates a perspective view of a horizontally sliding sash window and the device of the preceding figures wherein the device is operable to restrain the sliding sash in a partially open position.

FIG. 1 illustrates a single or double hung sash window 2 to which has been fixed a window sash restraint device 10 in accordance with an embodiment of the invention. The sash window 2 includes a window frame 3 containing a lower sash 4 and an upper sash 5 wherein at least the lower sash 4 is movable upwards and downwards in a vertical direction. The upper sash 5 may be fixed or may be movable also upwards and downwards depending on whether the window 2 is a single or double hung sash window 2. For the purposes of the disclosure of the present invention, the term "window sash" refers to a fixed or movable panel comprised of a frame surrounding a glass or other transparent, translucent or opaque pane or panel, the term "window frame" refers to the structure of the window in which the window sash is mounted and supported in a way that enables, in the case of a movable window sash, movement of the window sash relative to the window frame and relative to another window sash which may also be movable or fixed. The sash restraint device 10 is operable, as will be described in more detail below, to selectively restrain at least one of the window sashes 4, 5 in an open position relative to the window frame 3, in particular in a partially open position as opposed to a fully open position or a closed position, as illustrated in FIG. 11. Also, as will be described in more detail below, the sash restraint device 10 can be manually released to enable one or both of the window sashes 4, 5 to move freely between partially open, fully open and closed positions. FIG. 14 illustrates a horizontally sliding sash window 102 to which has been fixed the window sash restraint device 10.

Window Sash Restraint Device

With reference to the Figures, the window sash restraint device 10 of the present invention, which is operable for selectively restraining one or both of the window sashes 4, 5 in a partially open position relative to the window frame 3, broadly includes a body 15 adapted to be fixed to one of the window sashes 4, 5 or to the frame 3. The device 10 also includes a restraining member in the form of a restraining bolt 35 coupled to the body 10 and having an active condition and an inactive condition. In the active condition the restraining bolt 35 is operable to restrain the window sash 4, 5 in an opened position or a closed position relative to the window frame 3 and in the inactive condition the restraining member 35 allows movement of the window sash 4, 5 relative to the opened and closed positions. The device 10 includes a restraining mechanism 24 that is operable for securing the restraining bolt 35 in the active condition. The restraining mechanism 24 is manually releasable to thereby release the restraining bolt 35 from the active condition. As will become apparent from the below description, the device 10 preferably includes a manual release means, configured for concurrent (or simultaneous) two handed manual operation, for manually releasing the restraining mechanism 24. In a preferred form, the restraining mechanism 24 is preferably manually releasable by a concurrent two step process.

Accordingly, embodiments of the present invention are advantageous in that the device 10 is operable to selectively restrain the window sash 4, 5 in an open or closed position relative to the window frame 3 and can be manually "unlocked" form such position without requiring a key. Embodiments of the present invention are advantageous in that a degree of manual dexterity required to "unlock" the device 10 is unlikely to be possessed by a young child.

Figure 2:
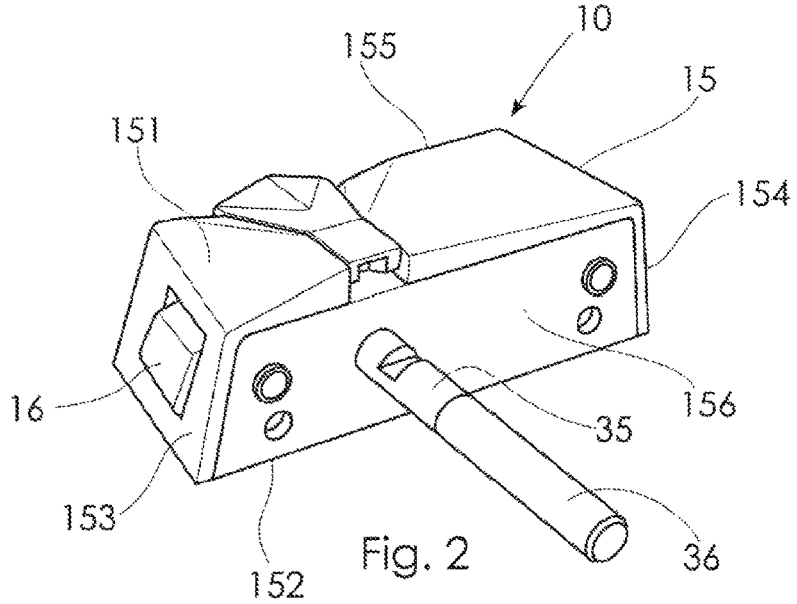
FIG. 2 illustrates a perspective view of a window sash restraint device in accordance with an embodiment of the invention, the device including a restraining bolt projecting from a rear of a body of the device an in an active condition.
Figure 3:
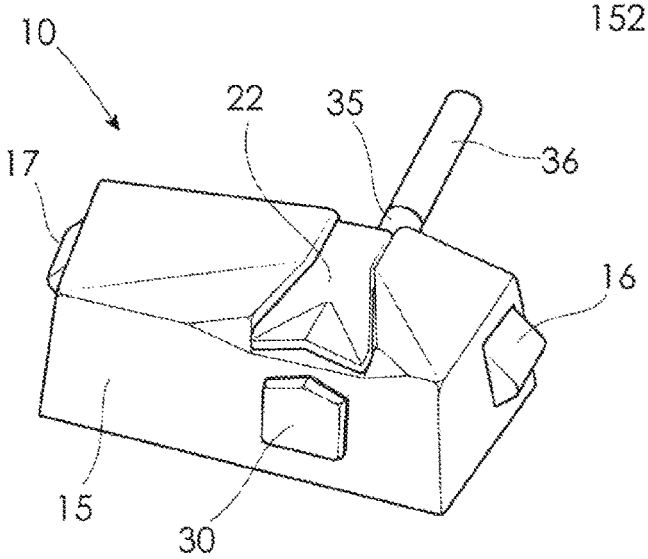
FIG. 3 illustrates a reverse perspective view of the window sash restraint device of FIG. 2 wherein a manually operable button extending from an opposite side of the body has been depressed to actuate the restraining bolt to its active condition.
Figure 4:
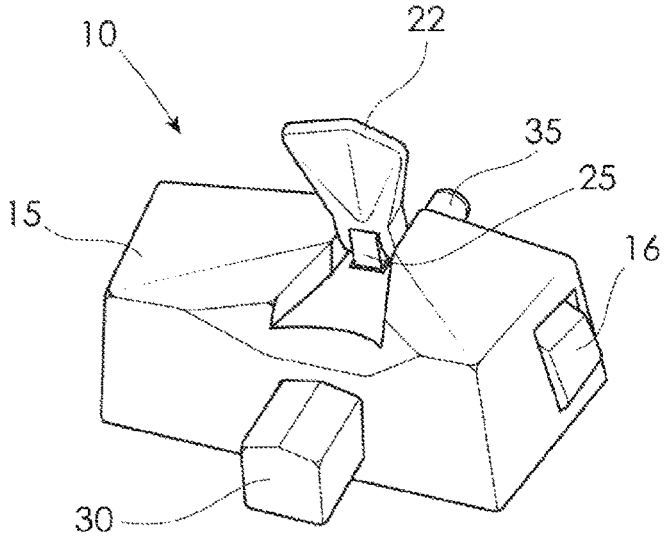
FIG. 4 illustrates a reverse perspective view of the window sash restraint device of FIG. 2 wherein a pair of manually operable levers on opposite ends of the body are manually displaced into the body and a lever on the top of the body has been manually displaced away from the body to thereby operate the release means to release the restraining bolt from the active condition to the inactive condition.
Figure 5:
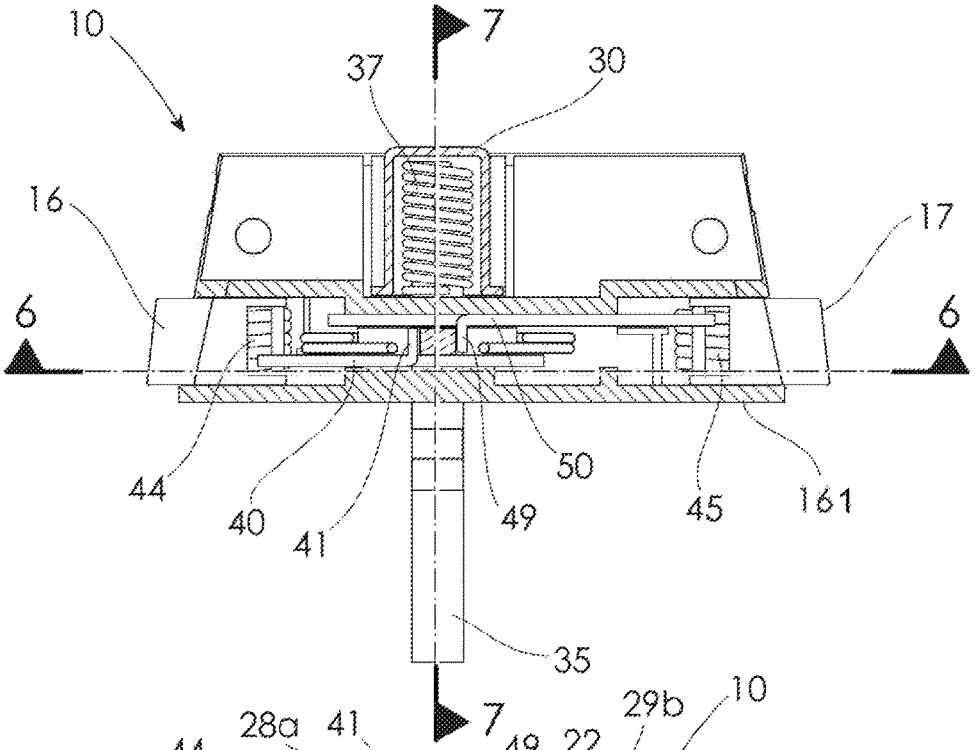
FIG. 5 illustrates a top view of a horizontal cross section of the device wherein the restraining bolt is in the active condition.

FIGS. 2, 3 and 4 illustrate front and rear perspective views of a window sash restraint device 10 in accordance with an embodiment of the invention. The body 15 of the device 10 is in the form of a hollow substantially rectangular shaped prism. Accordingly, the body 15 includes a top and bottom 151, 152 extending between longitudinally opposite ends 153, 154. The body 15 also includes a front and a rear 155, 156 extending between the opposite ends 153, 154. Referring to the exploded view of the device 10 illustrated in FIG. 11, the body 115 comprises a frame 161 including a plurality of mounting apertures 19 for mounting the device 10 to a window sash 4, 5 or a window frame 3. A replaceable cover 14 is adapted to be coupled to the frame 161 to thereby form the body 15. The cover 14 has a pair of lugs 14*a*, 14*b* one each side for engagement with a pair of recesses 16*b*, 16*c* in the base of the frame 161. The cover 14 is preferably formed of a metal or polymer material and is coated with a colour compound or contains a pigment of one of a selection of different colours such that a retailer can stock the device 10 and the covers 14 in a variety of colours that are subsequently assembled together by the end user. The provision of removable covers 14 in a variety of colours is advantageous in that it means that a retailer need not stock large volumes of the device 10 in each of several different colours to cater for the needs of their customers.

The frame 161 of the body 15 may preferably be made of plastic or another suitable rigid material such an alloy such as brass, aluminium, steel or the like. The frame 161 of the window sash restraint device 10 is adapted to be fixed relative to a window sash, such as the movable lower window sash 4 of the window 2 of FIG. 1. As shown in FIG. 1, the device 10 is adapted, in use, to be fixed relative to the window sash 4 and to enable the window sash 4 to be opened to a predetermined open position and to be selectively restrained in the predetermined open position. It is to be appreciated, that the device 10 could be fixed to the window frame 3 rather than the sash 4. The window sash 4 may be opened, for example, to provide a 125 mm high opening or any other predetermined opening size that would prevent a child from falling out of the opened window 2, and the window sash 4 may be restrained in the predetermined open position by the device 10. As illustrated in FIG. 14, the device 10 may be fixed to the movable window sash 104 or to the frame 103 of a horizontally sliding sash window 102. Furthermore, the device 10 is adapted to enable the window sash 4, 104 to be released from the predetermined open position and to be moved relative to the predetermined open position to, for example, a closed position or a fully open position.

Referring to the embodiment of the device 10 illustrated in FIGS. 2 to 11, the restraining bolt 35 has an active condition and an inactive condition wherein in the active condition the restraining bolt 35 is operable to restrain the open window sash 4, 104 in the open position illustrated in FIGS. 1 and 14. The restraining bolt 35 has an inactive condition in which the window sash 4, 104 is able to move relative to the open position, such as to a more open position or a closed position. The device 10 also includes a restraining mechanism 24 and a manually operable restraining mechanism release means comprised of a manually displaceable first release means 13 and a manually displaceable second release means 14. As will become apparent from the description below, the first release means 13 is preferably comprised of two independently operable release means 13*a*, 13*b* such that must both be manually operated/displaced before the second release means 14 can be manually operated/displaced. Furthermore, for the second release means 14 to be effective to release the restraining mechanism 24 the two independently operable release means 13*a*, 13*b* must be manually maintained in their respective displaced positions. Whilst embodiments of the present invention are described herein as a two step release mechanism, whereby operation of both of the first release means 13*a*, 13*b* typically is carried out simultaneously and therefore comprises the first step and manual operation of the second release means 14 is carried out subsequently yet concurrently and therefore comprises the second step, it is to be appreciated that such embodiments of the invention could be considered to comprise a three step release mechanism as the three independently operable release means 13*a*, 13*b*, 14 must all be manually displaced concurrently to release the restraining mechanism 24. In other words, the three independently operable release means 13*a*, 13*b*, 14 may be operated sequentially and concurrently to release the restraining mechanism 24 from the restraining bolt 35. Thus, where reference is made to embodiments comprising a pair of first release means 13*a*, 13*b* it is to be appreciated that these may be referred to or consider first and second release means and where reference is made to the second release means 14 this may be referred to as a third release means.

The restraining mechanism 24 includes a locking plate 25 that engages the restraining bolt 35 and is operable to secure the restraining bolt 35 in the active condition in a manner that will be described in more detail below. The restraining mechanism 24 can be manually released by the restraining mechanism release means to release the restraining bolt 35 from the active condition. The operation of the device 10 will now be described in detail with reference to the following description of the internal components of the device 10.

Restraining Bolt

FIGS. 2, 3, 5, 6 and 7 illustrate the device 10 in the active condition. In the active condition, the restraining bolt 35 projects through an aperture 12 through the rear 156 of the body 15. The rear 156 of the body 15 from which the restraining bolt 35 projects is adapted to be fixed in face to face relation to the sliding window sash 4 or the window frame 3. The bolt 35 penetrates through an opening (not shown) through the frame of the window sash 4 to which the device 10 is fixed. The opening through the frame of the window sash 4 may be preformed or may be drilled into the sash 4 by an installer of the device 10. One or more openings are provided in the frame of the other window sash 5 or in the window frame 3 and also may be preformed or drilled by an installer. The one or more openings provided in the frame of the other window sash or the window frame 3 are positioned such that at least one opening is at a position such that when the openings in the frames of the window sashes 4, 5 or the window frame 3 are aligned the window sash 4 to which the device 10 is fixed is opened to a predetermined height such as 125 mm. Another such opening may be provided in the frame of the other window sash 5 or in the window frame 3 such that when the openings in the frames of the window sashes 4, 5 or the window frame 3 are aligned the window sash 4 to which the device 10 is fixed is in a closed position. It is to be appreciated that the sliding sash window of FIG. 14 may be similarly provided with a hole in the movable window sash 104 to which the device 10 is fixed and one or more openings in the frame 103 or the other one of the sashes 105 such that the openings in the sashes 104, 105 or the window frame 103 are aligned the window sash 104 to which the device 10 is fixed is opened to a predetermined height such as 125 mm or is in a closed position.

The restraining bolt 35 is coupled to a button 30 that protrudes from the front 155 of the body 15. The 30 can be depressed to actuate the bolt 35 from the inactive to the active condition. In the active condition, the bolt 35 penetrates through both of the aligned openings in the frames of both of the window sashes 4, 5, 104, 105 or the window frame 3, 103 to thereby restrain the sliding window sash 4, 104 relative to the other window sash 5, 105 or fixed window frame 3, 103. When a user wishes to close the sliding window sash 4, 104 or open the sliding window sash 4, 104 beyond the predetermined open position, the user operates the device 10 as will be described below.

The restraining bolt 35 also includes an extension portion 36 that is selectively attachable to the end of the bolt 35 via a threaded connection arrangement therebetween. The extension portion 36 is operable for use with, in particular, double hung sash windows where it is necessary for the restraining bolt 35 to have sufficient length to pass through the thickness of the frames of two overlapping window sashes 4, 5. The aforementioned embodiment adds to the flexibility of the device 10 for use with a variety of window types.

Securing Means

Referring to FIG. 3, in which the restraining bolt 35, is in the active condition, the restraining mechanism 24 is operable for securing the restraining bolt 35 in the active condition. The restraining mechanism 24 is comprised of a locking plate 25 that is moveable in a direction perpendicular to a longitudinal axis of the restraining bolt 35. The locking plate 25 includes an aperture 26 through which the restraining bolt 35 passes and is movable in an axial direction therethrough. The locking plate 25 includes a retaining portion 27 at an edge of the aperture 26 that is operable to be located within a transverse groove 36*a* in the restraining bolt 35 when actuated to the active condition. The restraining mechanism 24 also includes a biasing means in the form of a pair of torsion springs 29*a*, 29*b* that are operable to bias the retaining portion 27 of the locking plate 25 into the groove 36*a* of the restraining bolt 35. Thus, the restraining mechanism 24 is operable to automatically secure the restraining bolt 35 upon manual actuation of the restraining bolt 35 to the active condition by manually depressing the button 30 coupled to the restraining bolt 35. The restraining bolt 35 also includes a spring 37 associated therewith that is operable to bias the restraining bolt 35 from its maximum displacement position protruding from the rear 156 of the body 15, corresponding to the active condition, towards a position in which the restraining bolt 35 is withdrawn into the body 15, corresponding to the inactive condition. The restraining mechanism 24 is operable to prevent the spring 37 from biasing the restraining bolt 35 from the active condition towards the inactive condition until the restraining mechanism 24 is manually released in a manner that will now be described. The restraining bolt 35 also includes, though this feature is not necessary, a further groove. 36*b* for engagement with the locking plate 25 when the bolt 35 is in the inactive condition.

Restraining Mechanism Release Means

Referring to FIG. 11, the device 10 includes two release members comprised of a pair of levers 16, 17 and associated elongated securing plates 40, 50. The pair of levers 16, 17 and associated securing plates 40, 50 are each independently displaceable from respective rest positions to displaced positions. The second release member includes a manually operable member in the form of a lever or cam 22 that is pivotally coupled to the locking plate 25. The manually operable lever 22 is manually displaceable from a rest position to a displaced position.

The pair of levers 16, 17 extend from the opposite ends 153, 154 of the body 15. The levers 16, 17 are adapted to be displaced by the thumb and forefinger of a user thus requiring one hand to operate both of the levers 16, 17. The levers 16, 17 are coupled to their respective plates 40, 50 which extend within the body 15 in a direction transverse to a longitudinal axis of the locking plate 25. Each of the plates 40, 50 includes a tab 41, 49 for engaging with respective shoulder portions 28*a*, 28*b* of the locking plate 25. The tabs 41, 49 are adapted to be located between the shoulders 28*a*, 28*b* and a top plate 16*a* of the frame 161 to physically prevent withdrawal of the retaining portion 27 of the locking plate 25 from the groove 36*a* in the restraining bolt 35. Thus, the tabs 41, 49 comprise a pair of retaining members that retain the locking plate 25 in engagement with the restraining bolt 35 until the two first release means are manually operated as described herein. The levers 16, 17 and the plates 40, 50 are biased by respective torsion springs 44, 45 so that the tabs 41, 49 are maintained in engagement with the shoulders 28*a*, 28*b* of the locking plate 25.

Figure 6:
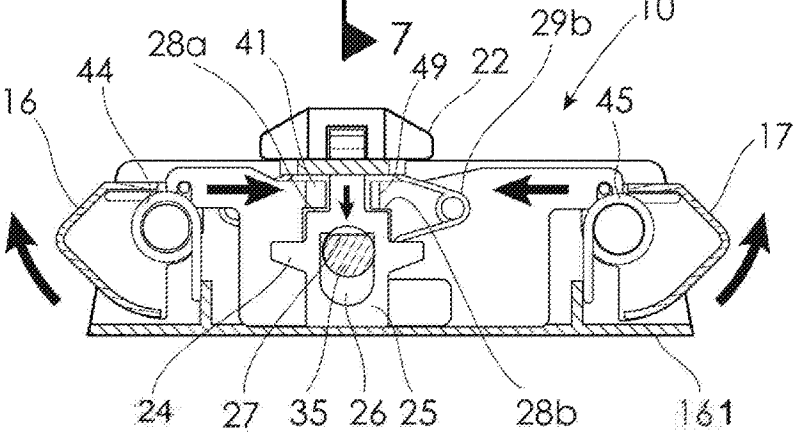
FIG. 6 illustrates a front view of a transverse cross section of the device wherein the restraining bolt is in the active condition and is maintained in the active condition by engagement with a locking plate.
Figure 8:
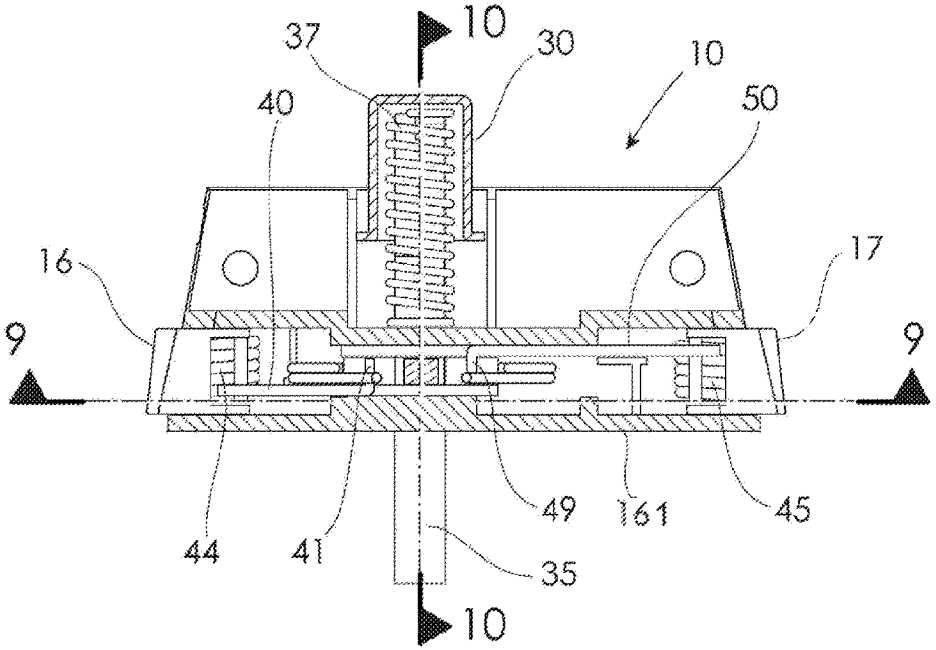
FIG. 8 illustrates a top view of a horizontal cross section of the device wherein the restraining bolt is in the inactive condition.
Figure 9:
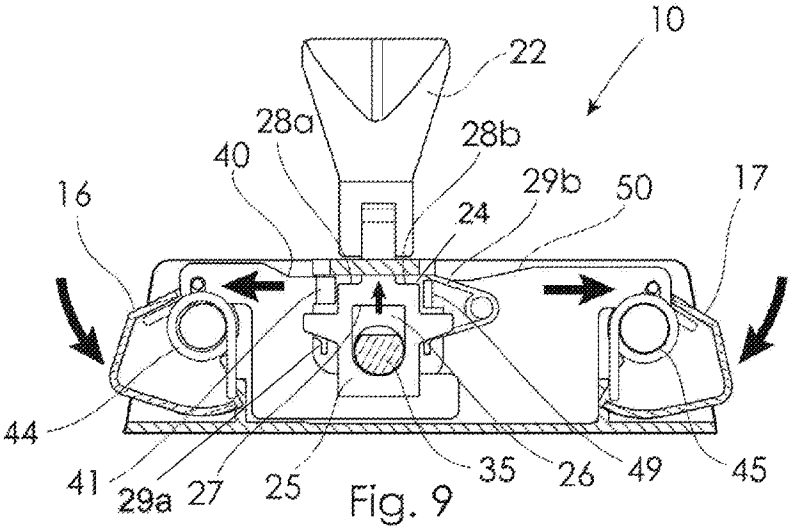
FIG. 9 illustrates a front view of a transverse cross section of the device wherein the restraining bolt is in the inactive condition and is disengaged by the locking plate.

To release the restraining bolt 35 from the active condition, the user must manually release the restraining mechanism 24 by operating the release means. Operation of the release means requires a first step of manually displacing the levers 16, 17 whereby the levers 16, 17 pivot about respective pivot axes 16*b*, 17*b* as illustrated in FIGS. 6 and 9. As described above, displacement of the levers 16, 17 is preferably carried out by the thumb and forefinger of one hand. As the levers 16, 17 pivot about their respective pivot axes 16*b*, 17*b* they are displaced into the body 15 and the plates 40, 50, that are respectively coupled to each of the levers 16, 17, are displaced to overcome the biasing force of the torsion springs 44, 45 to cause the tabs 41, 49 of the plates 40, 50 to move out of engagement with the shoulder 28 of the locking plate 25. It is to be appreciated that although one or the other of the levers 16, 17 can be displaced independently, only if both are displaced simultaneously or concurrently, will the tabs 41, 49 of both of the plates 40, 50 move out of engagement with the shoulder 28 of the locking plate 25 as required to carry out the subsequent second step of operating the release means.

The user carries out the second step of operating the release means by manually pivoting the lever 22 that is coupled via a pivotal coupling pin 22*a* to the locking plate 25. Displacement of the lever 22 is preferably carried out with the user's other hand that is not displacing the levers 16, 17. The pivoting lever 22 contacts the frame 161 at a fulcrum point 22*b* such that manually pivoting the lever 22 away from the frame 161 urges the locking plate 25 transversely relative to the restraining bolt 35. The retaining portion 27 of the locking plate 25 is thereby caused to move out of the groove 36*a* of the restraining bolt 35 and in doing so overcomes the biasing force applied by the pair of torsion springs 29*a*, 29*b*. Upon the retaining portion 27 coming out of engagement with the groove 36*a* the spring 37 associated with the restraining bolt 35 is operable to bias the restraining bolt 35 from its maximum displacement position protruding from the rear 156 of the body 15, corresponding to the active condition, towards a position in which the restraining bolt 35 is withdrawn into the body 15, corresponding to the inactive condition. Thus, the restraining mechanism 20 is manually released by the aforementioned two step process of operating the release means to thereby release the restraining bolt 35 from the active condition.

Thus, the device 10 is operable to enable a user to selectively release the restraining bolt 35 from the active condition to the inactive condition to enable a user to move the sliding window sash 4 relative to the predetermined open position. By selectively releasing the restraining bolt 35 from the active condition to the inactive condition the restraining bolt 35 is withdrawn from within the aligned openings in the window sashes 4, 5 or the window frame 3 to enable movement of the sliding window sash 4 relative to the predetermined opened position.

Restraining the Window Sash

Figure 7:
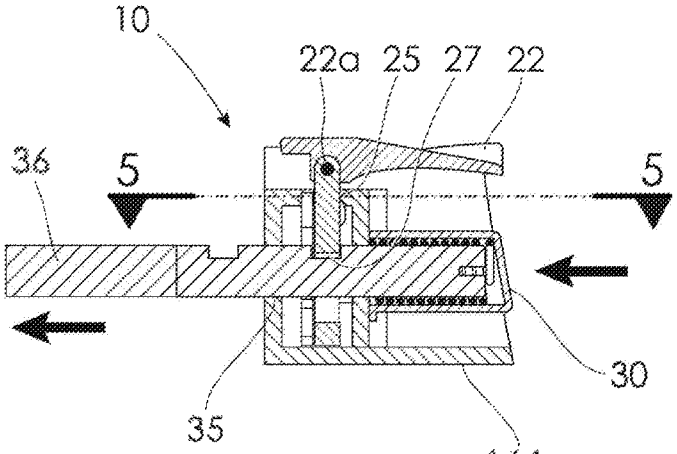
FIG. 7 illustrates a side view of a vertical cross section of the device wherein the restraining bolt is in the active condition.

When the device 10 has been operated such that the restraining bolt 35 is in the inactive condition, as described above, the user may move the sliding window sash 4, 104 relative to the predetermined open position either to a fully open position or to a closed position. When a user wishes to again restrain the sliding window sash 4, 104 in the predetermined open position, the user aligns the openings through the frames of the sliding window sash 4, 104 and the other window sash 5, 105 or the window frame 3, 103 through which the restraining pin 35 is operable to pass through. The user can then depress the button 30 to cause the restraining bolt 35 to be displaced from the inactive condition, illustrated in FIGS. 4, 8 and 10, wherein the restraining bolt 35 is retracted within the body 15, towards the active position as illustrated in FIGS. 2, 3, 5 and 7 wherein the restraining bolt 35 fully extends from the rear 156 of the body 15. When the user depresses the button 30 the user overcomes the biasing force applied by the biasing means 37 to move the restraining bolt 35 through the aperture 26 within the locking plate 25 in a direction perpendicular to the longitudinal axis of the locking plate 25. The restraining bolt 35 is moved through the aperture 26 within the locking plate 25 until the groove 36*a* in the restraining bolt 35 reaches the securing portion 27. When the groove 36*a* reaches the securing portion 27 the torsion springs 29*a*, 29*b* bias the locking plate 25 in a direction transverse to a longitudinal axis of the restraining bolt 35 such that the securing portion 27 moves into the groove 36*a* of the restraining bolt 35 to thereby the restraining bolt 35 in the active condition as illustrated in FIGS. 6 and 7.

Figure 10:
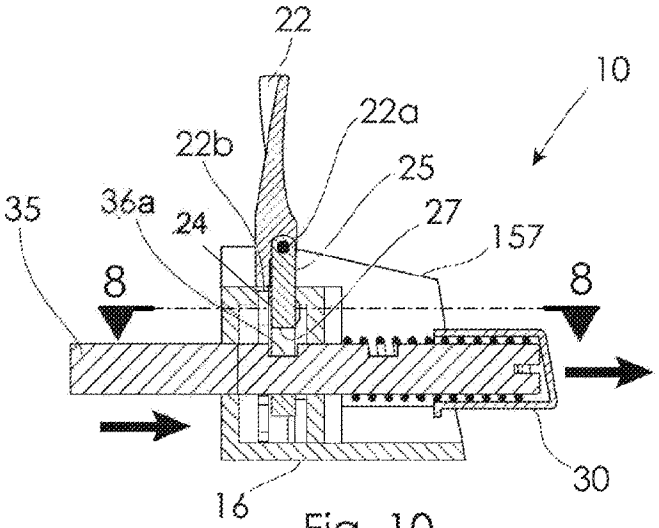
FIG. 10 illustrates a side view of a vertical cross section of the device wherein the restraining bolt is in the inactive condition.

FIGS. 6, 7, 9 and 10 illustrate the operation of the locking plate 25 of the securing means 20, the groove 36*a* of the restraining bolt 35 and the elongated securing members 40, 50. The restraining bolt 35 passes through the aperture 26 of the locking plate 25 and is operable to move therethrough from the active condition, as illustrated in FIGS. 6 and 7 in which the securing means 20 is operable to the restraining bolt 35, to the inactive condition, as illustrated in FIGS. 9 and 10 when the locking plate 25 has released the restraining bolt 35. FIGS. 6 and 9 also illustrate in more detail the operation of the elongated securing members 40, 50 to prevent the locking plate 25 from being displaced in the second step of the manual release mechanism until after the first step of the manual release mechanism is completed by the displacement of the levers 16, 17. As illustrated in FIG. 6, the enlargements 42, 52 of the securing members 40, 50 are positioned in abutment with the flange 28 of the securing means 20 to prevent the displacement of the locking plate 25 and to prevent withdrawal of the securing portion 27 from within the groove 36*a* of the restraining pin 35.

FIG. 9 illustrates operation of the manual release means. The first step involving manual displacement of the levers 16, 17 to cause displacement of the securing members 40, 50 away from the securing means 20 such that the enlargements 42, 52 move out of engagement with the flange 28. This is then followed by manual displacement of the locking plate 25 such that the securing portion 27 moves out of engagement with the groove 36*a* of the restraining bolt 35 to thereby release the restraining bolt 35 to be biased from the active condition to the inactive condition.

As stated above, the release means is preferably configured such that a small child of an age at risk of falling from open windows does not have sufficient manual dexterity to depress both of the levers 16, 17 and to simultaneously manually lift the lever 22 to withdraw the locking plate 25 with sufficient force to overcome the biasing force of the torsion spring 29*a*, 29*b*. Furthermore, the device 10 is suitable for use in relation to restraining a window sash 4, 104 in a substantially opened position relative to the window frame 3, 103. However, as described herein, the device 10 is also suitable for use in restraining the window sash 4, 104 in a close position relative to the window frame 3, 103 by provision of suitable holes in the window sash 4, 104 and frame 3, 103 that are aligned for penetration by the restraining bolt 35 when the window sash 4, 104 is closed.

Window Stay

Figure 12:
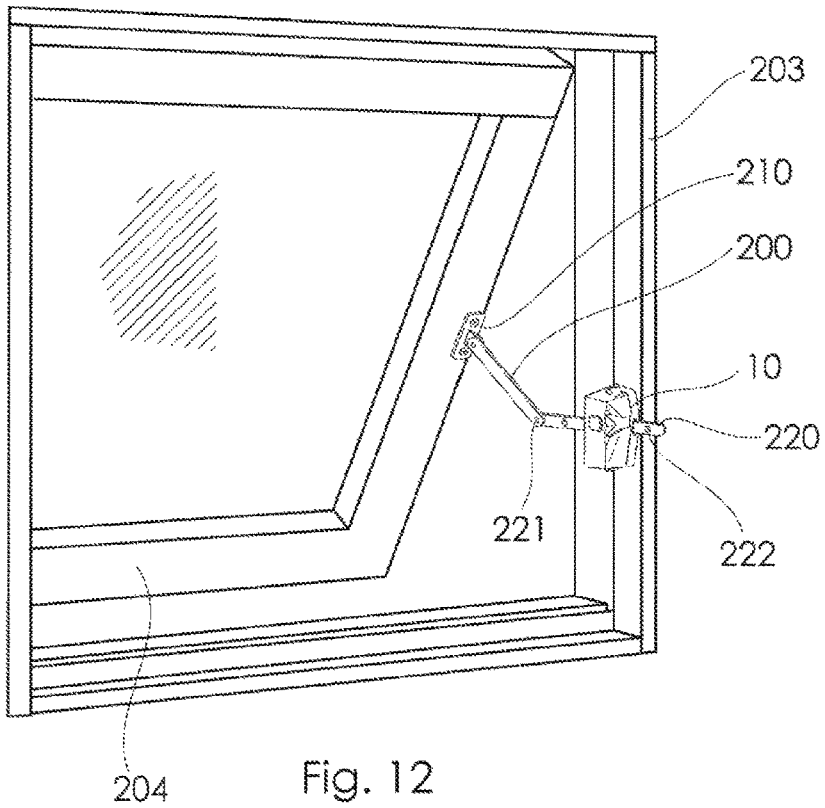
FIG. 12 illustrates a perspective view of a tilting sash window and the device of the preceding figures wherein a stay member is used with the device to maintain the window sash in a partially open position.
Figure 13:
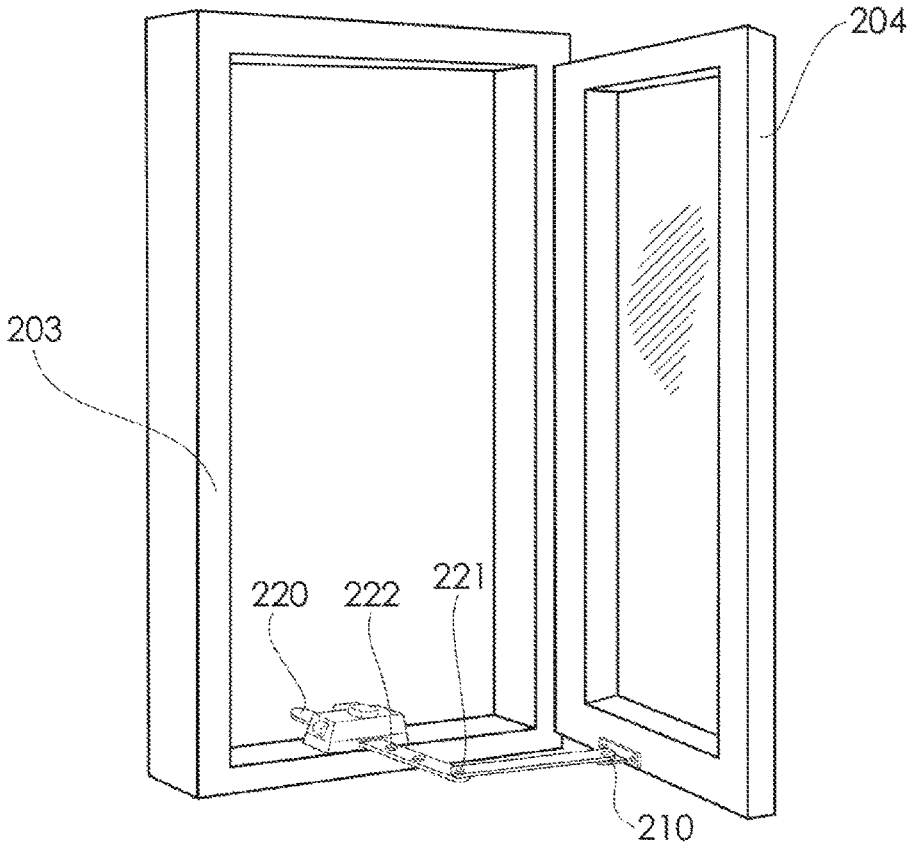
FIG. 13 illustrates a perspective view of a casement window and the device of the preceding figures wherein a stay member is used with the device to maintain the window sash in a partially open position.

In a further embodiment illustrated in FIGS. 12 and 13, the device 10 described above further includes, or is suitable for use with, an elongated stay member 200. The stay member 200 includes a first end 210 that is pivotally mounted to the window frame 203 or to a pivoting window sash 204 of a pivoting sash window or a casement window. The stay member 200 has a second end 220 comprising one or more apertures 222. The apertures 222 are engageable by the device 10 and, in particular, by the restraining bolt 35 when in the active condition when the body 15 of the device 10 is fixed to the other one of the window frame 203 and the window sash 204. Thus, the stay member 200 is operable in conjunction with the device 10 to maintain the pivoting window sash 204 at one or more predetermined partially opened positions relative to the window frame 203 when the device 10 is operated such that the restraining bolt 35 thereof is in the active condition. As can be appreciated, when the window sash 204 is to be opened further or closed, the release means of the device 10 is operated in the manner described above to manually release the securing means to withdraw the restraining bolt 35 from the aperture 222 in the second end 220 of the stay member 200. The stay member 200 also preferably includes an elbow joint 221 intermediate the ends 210, 220 thereof.

As mentioned above, where reference is made to embodiments comprising a pair of first release means 13*a*, 13*b* it is to be appreciated that these may be referred to or consider first and second release means and where reference is made to the second release means 14 this may be referred to as a third release means. Thus, in embodiments described herein, the first and second release means 13*a*, 13*b* are respectively displaced towards each other in first and second directions (e.g. opposite directions) and the third release means 14 is displaced in a third direction (e.g. transverse to the first and second directions) in order to release the locking plate 25 and thereby release the restraining bolt from the active condition to the inactive condition.

As can be appreciated, embodiments of the invention involve further advantages in that the device 10 can be operated by a person within a dwelling or a person outside the dwelling in an emergency, such as a fire, to manually release the restraining mechanism to release the restraining member from the active condition to enable the window to be released from a partially open position to enable the window to be fully opened. Such a feature of embodiments of the invention are advantageous in that in the event of an emergency, such as a fire, it is not necessary for a person within the dwelling to reach a key to un the window and exit the dwelling. It is also possible for a person outside the dwelling, such as fire or emergency response personnel, to unlock the window and enter the dwelling without breaking the window and risking injury associated with entering or exiting a window containing broken glass.

The claims defining the invention are as follows:

1. A window sash restraint device for selectively restraining a window sash in an open position relative to a window frame, the device comprising:

a body adapted to be fixed relative to the window sash;

a restraining member coupled to the body and having an active condition and an inactive condition, in the active condition the restraining member restrains the window sash in the open position and in the inactive condition the restraining member allows movement of the window sash relative to the open position of the sash; and a restraining mechanism for holding the restraining member in the active condition, wherein the restraining mechanism is manually releasable to thereby release the restraining member from the active condition, the restraining mechanism is manually releasable by concurrent two handed manual operation of a pair of manually displaceable first release members that are each independently manually displaceable from a respective rest positions to a respective displaced positions and a manually displaceable second release member that is manually displaceable from a rest position to a displaced position, the second release member being operable to release the restraining mechanism only when the pair of first release members are both manually maintained in the respective displaced positions and wherein the restraining mechanism is released when the second release member is manually displaced into the displaced position thereof, and the restraining member includes a bolt that is movable between extended and retracted positions relative to the body, wherein the active condition of the restraining member corresponds with the bolt being in the extended position and the inactive condition of the restraining member corresponds with the bolt being in the retracted position, wherein the bolt is urged into the retracted position upon release of the restraining mechanism.

2. The window sash restraint device of claim 1, wherein the pair of first release members are biased from the respective displaced positions thereof towards the respective positions thereof and the second release member is biased from the displaced position thereof towards the rest position thereof.

3. The window sash restraint device of claim 1, wherein the pair of first release members are at substantially opposite ends of the body.

4. The window sash restraint device of claim 1, wherein the first release members are in the respective rest positions when extending from opposite ends of the body and are in the respective displaced positions when displaced towards the body.

5. The window sash restraint device of claim 1, wherein the manual displacement of the second release member includes manually displacing the second release member relative to the body.

6. The window sash restraint device of claim 1, wherein the second release member includes a lever that is manually displaceable away from the body.

7. The window sash restraint device of claim 1, wherein the first release members are displaceable in a direction that is transverse to a direction in which the second release member is displaceable.

8. The window sash restraint device of claim 1, wherein the restraining mechanism includes a securing member that engages the restraining member when the restraining member is in the active condition and disengages the restraining member when the restraining mechanism is released.

9. The window sash restraint device of claim 1, wherein the restraining mechanism is adapted for automatically engaging the restraining member in response to manual displacement of the restraining member from the inactive condition to the active condition.

10. The window sash restraint device of claim 1, wherein the window sash is a first window sash and the bolt is adapted in the extended position to enter an opening in the first window sash and at least one opening in a second window sash or the window frame to restrain the first window sash relative to the window frame.

11. The window sash restraint device of claim 1, wherein the bolt is adapted in the extended position to enter an opening in the window frame and at least one opening in the window sash to restrain the window sash relative to the window frame.

12. A window assembly comprising the window sash restraint device of claim 1.

* * * * *